United States Patent [19]

Monceret

[11] Patent Number: 4,957,020

[45] Date of Patent: Sep. 18, 1990

[54] ADJUSTABLE PLIER

[76] Inventor: Arthur Monceret, Rt. 5, Box 126, Killen, Ala. 35645

[21] Appl. No.: 419,321

[22] Filed: Oct. 10, 1989

[51] Int. Cl.[5] ..... B25B 7/04; B25B 7/06

[52] U.S. Cl. ..... 81/414; 81/416; 411/383; 411/393; 411/222

[58] Field of Search ..... 81/414, 407, 405, 411, 81/412, 416; 411/325, 271, 383, 384, 393, 222

[56] References Cited

U.S. PATENT DOCUMENTS 793,402 6/1905 Storsberg ..... 411/271 X 4,271,732 6/1981 Vaughan, Jr. ..... 81/414

FOREIGN PATENT DOCUMENTS 1255538 1/1961 France ..... 81/416

*Primary Examiner*—D. S. Meislin

*Attorney, Agent, or Firm*—Norton & Luhn

[57] ABSTRACT

This disclosure is directed to the use of an adjustable hand tool which employs means to prevent the separation of the cross members. Specifically the invention uses an arcquate circular cross section rib which selectively engages one of several arcquate circular cross sectioned grooves. The pliers further have a pin with a cap at one end and externally threaded at the other. The pin has internal threads with a securing screw threadably mounted therein. A threaded cap is threadably attached to the pin and the securing screw tightened against the cap to cause it to remain in its selected position.

1 Claim, 1 Drawing Sheet

ADJUSTABLE PLIER

This application relates generally to adjustable hand pliers and more particularly is concerned with adjustable hand pliers comprised of members pivotally connected by tongue and groove elements.

Adjustable hand pliers containing tongue and groove joint elements tended to be unsatisfactory for the reason that with the wear of interlocking elements there was a tendency for these elements to disengage from one another under use. This constituted a serious deficiency in that injury might result to the operator as well as the ineffectiveness of the hand tool. Additionally, many of the adjustable hand plies available have a pin connecting the two movable jaws. One end of the pin is equipped with a cap and the other is secured by a threaded nut.

One problem with this arrangement is the disengagement of the nut from the pin thus allowing the jaws to become disengaged. It is therefore an object of this invention to eliminate this danger and to selectively secure the nut to the pin.

Another object of the invention is to provide an adjustable hand tool which is adapted for heavy duty work and will have a long and safe useful life.

Another object of this invention is to provide adjustable hand pliers having crossed members pivoted by tongue and groove elements which are especially suited for heavy work.

Further objects and advantages will appear in the specifications and claims and will become apparent from the following description and explanation.

In the drawings, reference will be had to the parts in the specification wherein.

Figure 1:
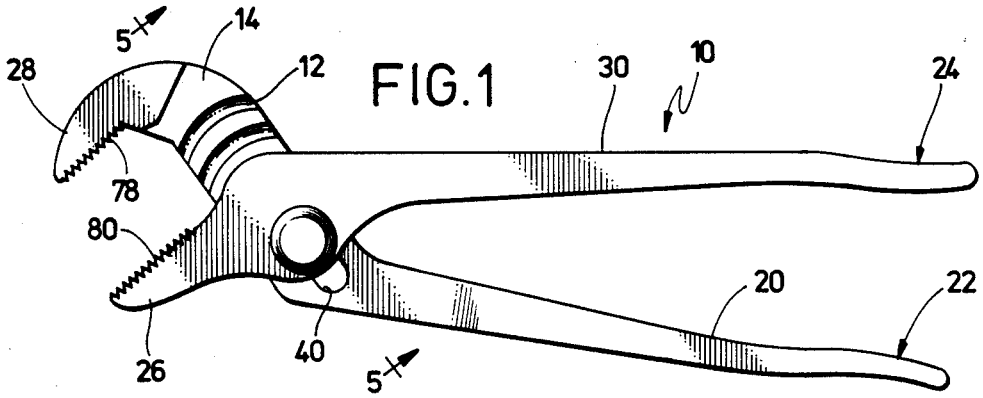
FIG. 1 is a plan view of one side of the pliers.
Figure 2:
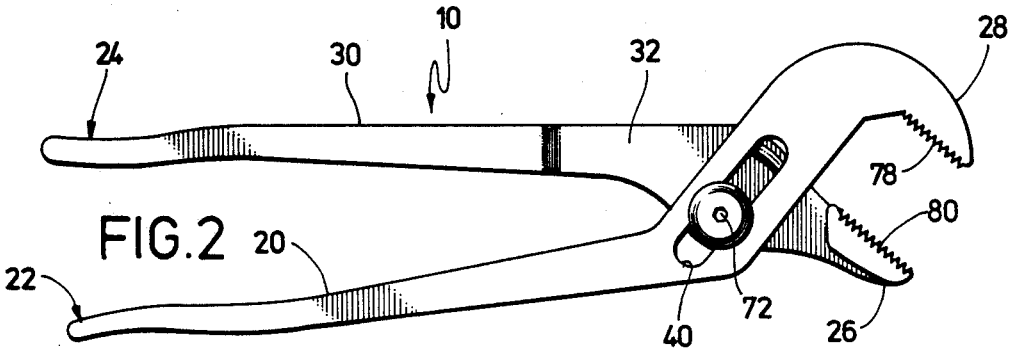
FIG. 2 is a plan view of the opposite side of the pliers shown in FIG. 1.

Referring to the drawings, the adjustable hand pliers 10 illustrated in FIGS. 1–6 are the type in which a plurality of arcuate circular cross sectioned grooves 12 are disposed in concentric fashion on one pivot area 14. The pliers consist of two members 22 and 24, which are crossed in scissoring relationship to each other. Each member has a pivot area 14 and 16 respectively. Each member contains a jaw 26 and 28 on members 22 and 24 respectively. On the opposite side of each pivot area and away from the jaw, each member has a handle 20 30 respectively. An enlarged pivot area 32 and 34 respectively is intermediate of the jaw and handle of each member. These pivot areas are spaced from each other in parallel planes to provide for positioning of the pivot area. The sides of the pivot area are kept in close proximity to each other to avoid the tongue from jumping from one groove to another when create force is applied to the handle of the pliers.

Pivot side 14 contains a plurality of concentric circular cross sectioned grooves 12 adjacent to face 34 of member 22. An elongated slot 40 is found through pivot side 34. The longitudinal axis of said slot 40 is disposed in a transverse or radial direction to the circular grooves 12. An arcuate circular cross sectioned rib 42 is disposed on pivot fare 32 concentrically with respect to aperture 44. Aperture 44 is through the pivot area 16 of member 24 with its longitudinal axis being perpendicular to pivot face 32.

A pivot or pin member 46 is provided Member 46 has at one end a head 48. A pivoting surface 50 is positioned adjacent to head 48. A smaller radius pivoting surface 51 is positioned next to pivoting surface 50. At the end of pivot member 46 opposite cap 48 are threads 52. Bore 54 is provided through the longitudinal axis of pivot member 46. Internal threading 58 is provided within bore 54 at the threaded end 52 of pivot number 46. A cap number 60 is provided with an aperture 62. Aperture 62 is provided with internal threads 64. Threads 64 are sized to engage threads 52 on member 46.

A securing screw 66 is provided. Said screw 66 is provided with external threads 68 along its exterior longitudinal axis. At one end 70 of screw 66 is provided a hexagonally shape aperture 72. At the opposite end from said hexagonal aperture 72 is a blunt end 74.

In fabricating the pliers, pivot faces 32 and 34 are positioned face to face aligning bore 44 with slot 40 and further positioning said members such that jaw 28 and jaw 26 are juxtaposed. The two members are then joined by placing pin 46 through slot 40 and through bore 44. Screw 66 is threadably received within aperture 54 with end 70 toward head 48 of pin 46. Cap 60 is threadably received onto threaded end 52 of pivot member 46.

Figure 3:
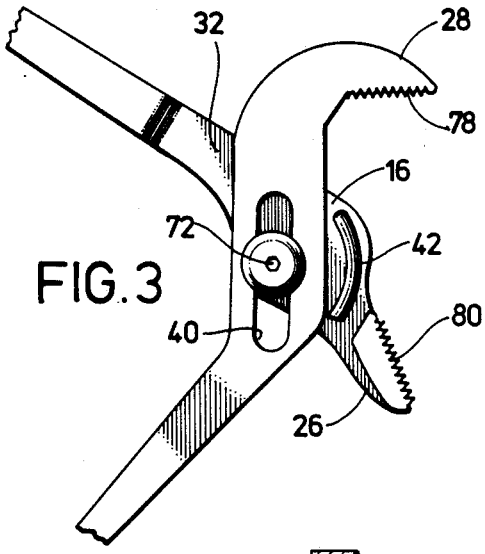
FIG. 3 is a detailed view of FIG. 2 showing the relative position of the jaws when at the end of their extreme movement in opposite directions of adjustment.
Figure 4:
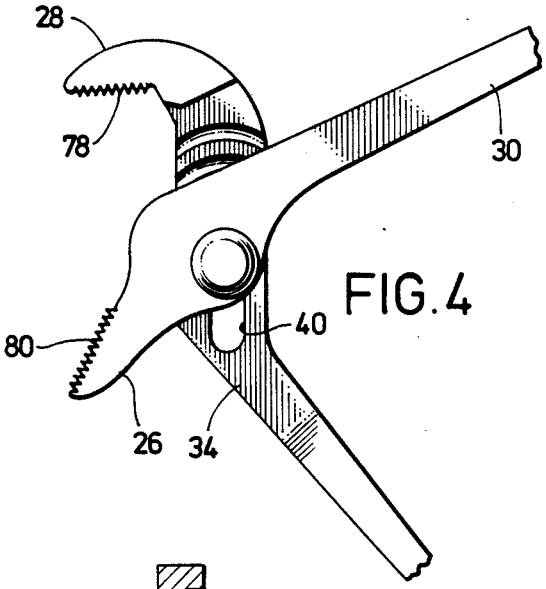
FIG. 4 is a detailed view of FIG. 1 showing the relative position of the jaws when at the end of their extreme movement in opposite directions of the adjustment.
Figure 5:
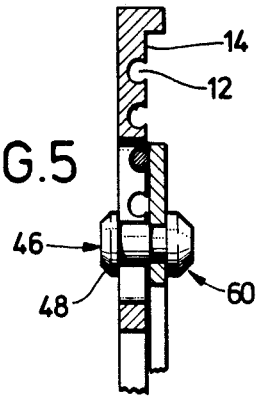
FIG. 5 is a detailed sectional view taken along line 5—5 of FIG. 1.
Figure 6:
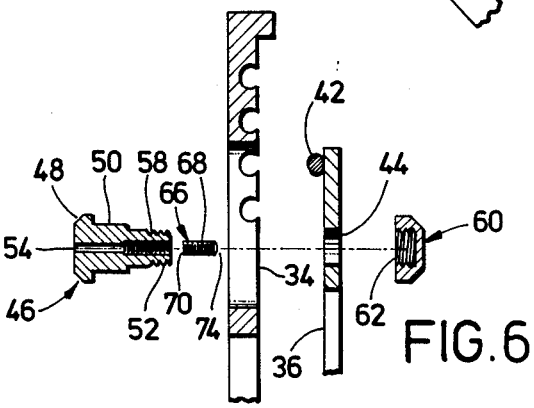
FIG. 6 is a fragmentary view of FIG. 5 showing the cross-sectional view of the pivot end.

The tongue and groove connections provide a means for adjusting the opening between jaws 28 and 26. Each jaw contains a work engaging surface 78 and 80 respectively. The tongue and groove interlocks are arranged in concentric relationship with the pivotal connection formed about pivot member 46. As shown in FIG. 3, by manipulating the handles of the pliers so as to open the jaws wide, the arctuate circular cross sectioned rib 42 can be disengaged from a selected groove member 12 and member 24 can be moved along the length of slot 40 for engagement of rib 42 with any of the several selectable grooves 12. Movement of member 24 in the direction of jaw 28 brings the jaws in closer position, whereas the movement in the opposite direction places the jaws further apart. When the proper adjustment has been obtained, the jaws are manipulated to bring rib 42 into the selected adjacent groove 12.

In order to facilitate the scissor movement of members 24 and 22 about pivot member 46, it is necessary that distance along the longitude axis of pivot member 46 between head 48 and cap 60 be selectively adjustable. By rotating cap 60, this distance is selectively obtained. In order to maintain this selective adjustment, screw 66 is rotated such that end 74 of screw 66 applies pressure to the inner portion of cap 60. The force so applied to cap 60 by screw 66 prevents cap 60 from moving from its selected position on pin 46. This maintains the spacing between members 22 and 24.

In these pliers the possibility of the arctuate circular cross sectioned rib jumping from one groove to another under pressure is essentially eliminated by reason of the joint formed by the circular cross section of the rib and the mating circular cross section groove as explained herein above.

It will of course be understood that there are changes which may be made in the form, details, arrangement and proportion of the parts without departing from the scope of the invention which consists of the matter shown and described herein and set forth in the appended claims.

What is claimed is:

1. Pliers having a pair of crossed members with a pivotal joint between members comprising:

A bore in one member, a slot in the other member and a pivot member slidably received within said bore and said slot whereby one member may move relative to the other member lengthwise of the slot and with jaws on each members; said pivotal joint comprising an arctuate circular rib cross sectioned on one said member and a plurality of open-ended circular cross sectioned grooves on the other said member extending crosswise of the slot, the said grooves being centered on the center line of the slot, said rib being receivable in any one of said grooves to provide a connection between the members carrying the working pressure of the jaws, the said rib and the said groove in which the said rib is received having surfaces engaging under working pressure of substantially the same radius causing the engaging surfaces to remain engaged under working pressure; said pivot member having a bore along its longitudinal axis with a head at one end, external thread into at the other end and said bore having internal threads; a screw having external threads along its longitudinal axis threadably received within said bore, said screw positioned with an aperture toward said head of said pivot member, and a cap having an aperture at one end and closed on the other end, said cap being threadably received over said pivot member at its threaded end.

* * * * *